United States Patent [19]

Miller

[11] Patent Number: 5,012,965

[45] Date of Patent: May 7, 1991

[54] HOLSTER FOR A HANDGUN

[76] Inventor: David M. Miller, 7927 E. 77th Pl., Tulsa, Okla. 74133

[21] Appl. No.: 501,602

[22] Filed: Mar. 30, 1990

[51] Int. Cl.[5] ..... A45F 5/00; B65D 57/00

[52] U.S. Cl. ..... 224/255; 224/912; 224/230

[58] Field of Search ..... 224/198, 911, 912, 243, 224/245, 230, 231, 292, 255

[56] References Cited

U.S. PATENT DOCUMENTS

| | | | |
|---|---|---|---|
| 202,733 | 4/1878 | Le Page | 224/231 |
| 1,166,781 | 1/1916 | Parrish | 224/193 |
| 1,579,552 | 3/1924 | Ludlow | 224/912 |
| 3,749,293 | 7/1973 | Bianchi | 224/911 |

*Primary Examiner*—Henry J. Recla

*Assistant Examiner*—David J. Walczak

*Attorney, Agent, or Firm*—Head & Johnson

[57] ABSTRACT

A holster for use with a handgun having an open ended barrel, the holster being formed of a support structure having a generally horizontal base member with an interchangeable elongated barrel receiving member affixed to and extending upwardly from the base member and configured to removably telescopically receive the open end of the barrel of a handgun, and elongated guide members affixed to the base member at each end and extending upwardly therefrom, the base members and barrel receiving member being substantially in a common plane and dimensioned to be received in a pocket or pouch so that the holster apparatus comfortably supports a handgun in a pocket or pouch in a way so that it can be readily withdrawn.

6 Claims, 2 Drawing Sheets

10
16A
16
40
18A
12
18
14A
14

32
28
4
4
10
40
14
42

14
18A
24
18
20
22
18B
26
12

32
10
16A
16
12A
36
34
12
18
18B
2
2
28
38
14A
14
30
12B

HOLSTER FOR A HANDGUN

SUMMARY OF THE INVENTION

Many people carry handguns for protection. Usually, handguns are carried in a coat pocket or purse. Others have provided holster devices for supporting a gun, but most known types of holsters require a gun to be worn exterior of clothing, such as the type of holster worn from a belt and used by police officers, while another common type of holster is worn on a strap around the neck or shoulder of a user with the holster being supported inside the coat of a user. These type of holsters are not usable for a small handgun carried for security purposes, such as in a coat pocket or a purse as above mentioned.

When handguns are carried in a coat pocket, they tend to turn and lie flat, causing a severe bulge and discomfort to a user. When a handgun is carried in a purse, it can become orientated in any direction. In either event, carrying a handgun in a purse or coat pocket may make it difficult to comfortably carry and particularly difficult to expeditiously retrieve the handgun when it is needed in an emergency.

The present disclosure is directed to an improved holster for a handgun to be used in a pocket or purse. The holster is formed of a support structure of strong stiff material, such as metal or strong plastic. The support structure has a generally horizontal base member with a first and second end. An elongated barrel receiving member is affixed to and extends upwardly from the base member and is configured to removably and telescopically receive the open end of the barrel of a handgun.

An elongated guide member, which may be and preferably is integral with the base member, extends upwardly from the base member at each end thereof. The base member, barrel receiving member and guide members are all in a common plane and are dimensioned to be received in a pocket or pouch.

The spacing between the guide members and the barrel receiving member is such to freely receive a handgun therein, with the handgun being held in a common plane to the base member, the barrel receiving member and the guide members. In the preferred arrangement, the barrel receiving member and one of the guide members are substantially parallel to each other, while the other guide member extends at an angle away from the gun receiving member. In another embodiment, each of the guide members extend slightly at an angle away from the barrel receiving member.

The support structure may be retained in a pocket or purse of a user and serves to retain a handgun in an upward position, with the handle being exposed and positioned for easy retrieval of the handgun. In addition, the holster of this disclosure may include a separate pouch that encompasses the support structure for receiving a portion of a handgun therein, with the handle of the handgun extending above the pouch for immediate free access.

The barrel receiver member is preferably interchangeable so as to accept the barrels of guns of differenct calibers.

A better understanding of the invention will be had by reference to the following description and claims, taken in conjunction with the attached drawings.

DESCRIPTION OF THE PREFERRED EMBODIMENT

Figures 1, 2, 3, 4:
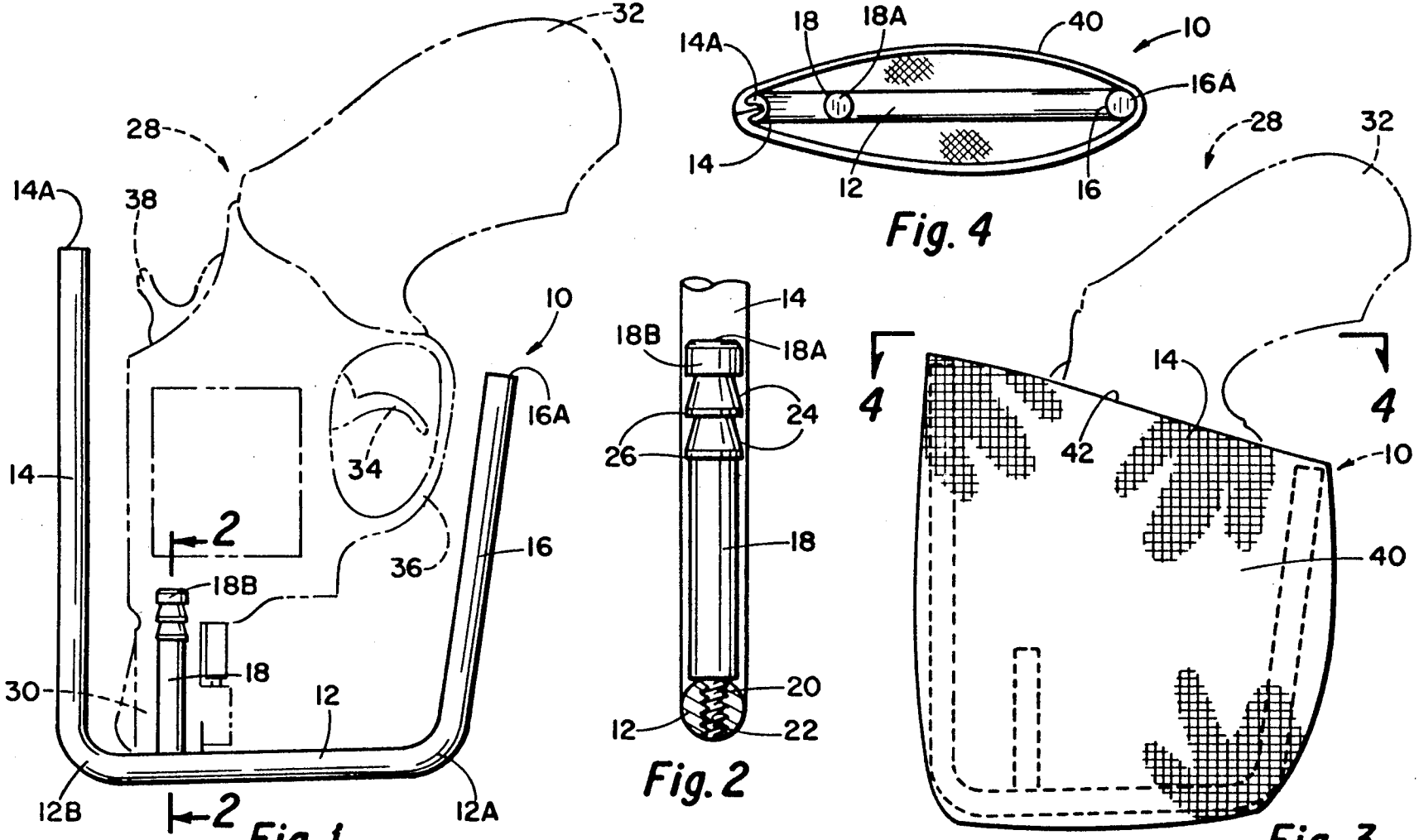
FIG. 1 is an elevational view of the handgun structural support of this disclosure, showing a handgun received therein in dotted outline.
FIG. 2 is a partial cross-sectional view taken along the line 2—2 of FIG. 1, showing one means of securing the barrel receiving member to the base member.
FIG. 3 is an elevational view of a pouch having the support structure of FIG. 1, in slightly reduced scale, positioned therein, showing the handle portion of a gun in the pouch and supported by the structure in dotted outline.
FIG. 4 is a cross-sectional view taken along the line of 4—4 of FIG. 3, showing the top of the pouch with the support structure therein, a handgun is not shown in this Figure.

Referring to the drawings and first to FIGS. 1–4, a first embodiment of the holster of this disclosure is shown. The holster includes a structural support member, generally indicated by the numeral 10. The structural support member is formed of an elongated strong material, preferably, but not necessarily, of cylindrical cross-sectional configuration that can be bent in the shape indicated. The structural member includes a generally horizontal base member 12 having a first end 12A and a second end 12B.

A first elongated guide member 14 extends upwardly from end 12B of the base member. A second guide member 16 extends upwardly from the base member first end 12A. The second guide member may extend perpendicular to base member 12 or, as shown, at an obtuse angle.

Intermediate the guide members 14 and 16 is an elongated barrel receiving member 18. As shown in FIG. 2, the barrel receiving member 18 may include a reduced diameter threaded portion 20 that is received in a threaded opening 22 in the base member 12.

The barrel receiver member 18 is preferably interchangeable so as to accept the barrels of guns of different calibers.

Barrel receiving member 18 is preferably of circular cross-section and dimensioned to slidably and telescopically receive the barrel of a handgun to be supported in the holster. The upper end 18A is preferably chamfered as shown. The barrel receiving member has a number of recesses 24 therein, providing increased external diameter circumferential ridges 26. The external diameter of ridges 26 is preferably the same as that of the end portion 18B. The diameter of ridges 26 and end portion 18B is slightly greater than that of the main portion of the barrel receiving member 18. The diameter of ridges 26 and end portion 18B is such as to slidably yet snugly receive the barrel of a handgun.

All of the basic elements of the holster structural support member 10 are in a common plane, that is, the base member 12, the first guide member 14, the second guide member 16 and the barrel receiving member 18 are preferably in a common plane.

FIG. 1 shows a handgun in dotted outline, generally indicated by the numeral 28. The handgun has a short barrel portion 30 that is telescopically positioned on the barrel receiving member 18. The handgun handle 32 extends upwardly above the upper end 16A of the second guide member 16. The length of the second guide member 16 is adjusted so that grasping of the handle 32 is unobstructed. The length of the second guide member 16 is such as to extend at least slightly beyond the position of the gun trigger 34 surrounded by trigger guard 36. In addition, the upper end 14A of the first guide membher 14 is slightly beyond the position of the gun hammer 38.

Figure 6:
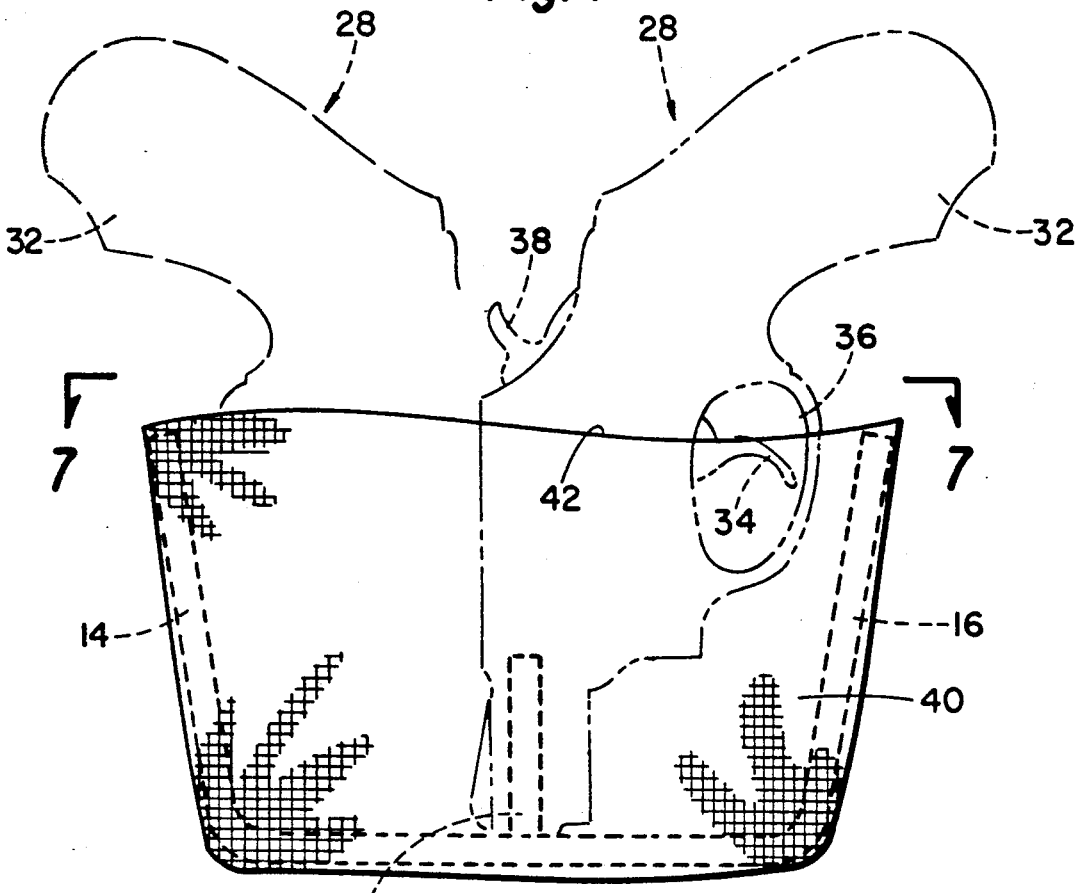
FIG. 6 is an elevational view of a pouch having the support structure of FIG. 5 therein, showing a handgun in dotted outline and showing the handgun can be supported in two separate positions in the pouch.

FIGS. 3 and 6 show the structural member 10 inside a pouch 40. The pouch serves to emcompass and protect most of the handgun 28 except for handle 32. Pouch 40 has an upper edge 42 that generally extends slightly above the upper ends 14A and 16A of the first and second guide members 14 and 16.

FIG. 4 shows the pouch 40 with structural member 10 therein but without a handgun. A handgun is inserted into the pouch and retained therein by inserting the end of the handgun barrel over the upper end 18A of the barrel retainer member 18.

Figure 7:
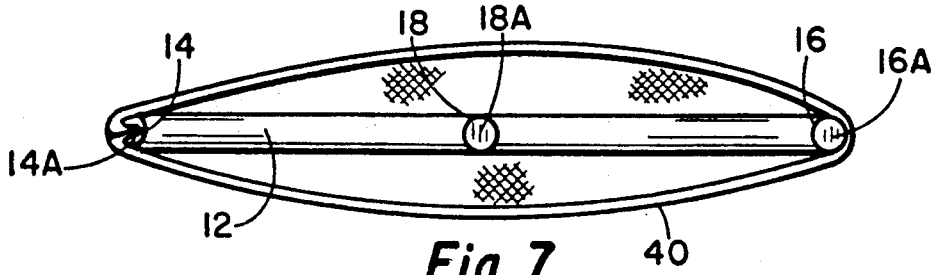
FIG. 7 is a top view of a pouch for use in a ladies purse having this support structure therein taken along the line 7—7 of FIG. 6, a handgun is not shown in this figure.
Figure 5:
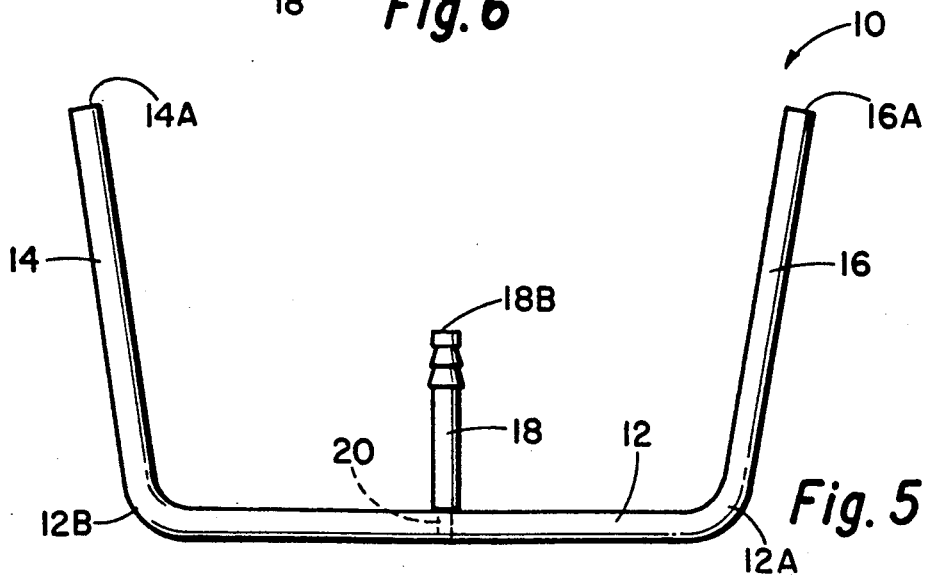
FIG. 5 is an elevational view of a support structure of this disclosure for supporting a handgun, showing an alternate embodiment wherein the support structure is configured to be received in the typical ladies purse.

FIGS. 5, 6 and 7 show an alternate embodiment of the holster primarily intended for use in a woman's purse. The same elements are employed and function as previously described, with the first and second guide members 14 and 16 being about the same length and each inclined at an obtuse angle with respect to the base member 12 in a direction away from the barrel support member 18. The pouch 40 functions as previously described. The arrangement in FIGS. 5, 6 and 7 permits handgun 28 to be placed in alternate positions. As shown in FIG. 6, the length of the first and second guide members 14 and 16 are such that the upper edge 42 of the pouch does not extend over the gun hammer 38.

FIG. 7 shows the arrangement of the structural member 10 and the pouch 40 of FIGS. 5 and 6 without a handgun therein. The embodiment of FIGS. 5, 6 and 7 is designed for use in a typical woman's purse so that the holster fits snugly within the purse and provides more vertical support of the holster which, in turn, provides more vertical support of a handgun positioned therein.

The holster is particularly adaptable with small handguns of the type carried by people for security and particularly by women in their purses. The holster can be used with or without pouch 40, however, the use of the pouch is desirable in that it protects the handgun while in position in a pocket or purse and prevents other items from inadvertently becoming entangled with the handgun, such as items which might lodge within the trigger guard 36 and thereby interfere with immediate use of the handgun. Since the barrel receiver member 18 is interchangeable, the same holster structural support member can be used for many different caliber handguns.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. For use with a handgun having an open ended barrel, a holster apparatus adapted to be inserted into a pouch formed of front and back panels secured to each other along opposite side edges and bottom edges and being open along the top edges comprising:

a support structure having a generally horizontal base member with a first and second end;

an elongated barrel receiving member affixed to and extending upwardly from an intermediate location of said base member and configured to removably telescopically receive the open end of the barrel of a handgun thereon when said handgun is received in said pouch;

a first elongated guide member affixed to said base member at said first end thereof and extending upwardly therefrom; and a second elongated guide member affixed to said base portion at said second end thereof and extending upwardly therefrom, said base member, barrel receiving member and said guide members being spaced apart and positioned substantially in a common plane and configured to be received in said pouch such that said base member is positioned adjacent to the bottom edges and said guide members are positioned adjacent respective side edges of said pouch.

2. A holster apparatus according to claim 1 wherein said base member and said first and second guide members are integrally formed of a unitary elongated member.

3. A holster apparatus according to claim 2 wherein said unitary elongated member is in the form of a metal rod bent to provide said portions.

4. A holster apparatus according to claim 3 wherein said barrel receiving member is threadably secured to said base member.

5. A holster apparatus according to claim 1 including:

a pouch of flexible material receiving said support structure and dimensioned to receive a handgun therein.

6. A holster apparatus according to claim 4 wherein said barrel receiving member is interchangeable and may be of different diameters to thereby receive the barrels of different caliber guns.

* * * * *